United States Patent [19]

Romberg

[11] Patent Number: 4,468,315

[45] Date of Patent: Aug. 28, 1984

[54] HYDROGENATION OF COAL

[75] Inventor: Helmut Romberg, Bad Duerkheim, Fed. Rep. of Germany

[73] Assignee: BASF Aktiengesellschaft, Fed. Rep. of Germany

[21] Appl. No.: 337,682

[22] Filed: Jan. 7, 1982

[30] Foreign Application Priority Data

Jan. 20, 1981 [DE] Fed. Rep. of Germany ..... 3101598

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 1,876,009 | 9/1932 | Kraugh | 208/10 |
| 4,113,602 | 9/1978 | Gorbaty | 208/10 X |
| 4,152,244 | 5/1979 | Raichle et al. | 208/8 R |
| 4,189,375 | 2/1980 | Kirby et al. | 208/10 X |
| 4,222,844 | 9/1980 | Nizaoff | 208/10 X |
| 4,297,200 | 10/1981 | Briley | 208/10 |

*Primary Examiner*—Delbert E. Gantz
*Assistant Examiner*—William G. Wright
*Attorney, Agent, or Firm*—Keil & Witherspoon

[57] ABSTRACT

A process for hydrogenating coal which has been mixed with oils, by bringing the coal slurry to the reaction pressure by pumping, heating the slurry and catalytically hydrogenating it with hydrogen, wherein some or all of the hot gases and vapors formed during hydrogenation are intimately re-mixed with the coal slurry in a plurality of stages. After the first mixing stage, the gases are freed from the product, and the product-free gases, especially hydrogen, are used as a thermal medium.

5 Claims, 1 Drawing Figure

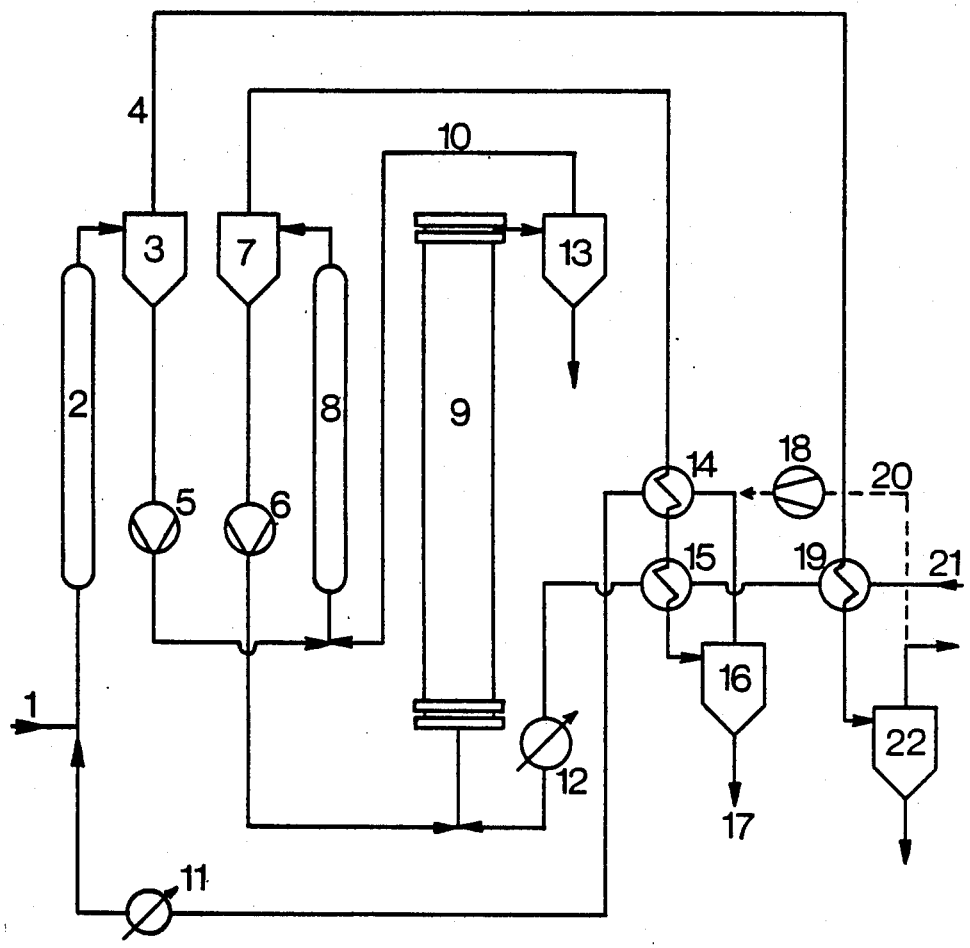
4
10
3
7
13
2
8
9
14
18
20
5
6
15
19
21
16
1
22
12
17
11

HYDROGENATION OF COAL

In the conventional process for hydrogenation of coal, the economics greatly depend on the utilization of the heat of reaction generated in the process. Conventionally, the heat content of the reaction vapors leaving the reactor is utilized in order to pre-heat the coal slurry, for the reaction, in counter-current in tube bundle heat exchangers. This presents major problems due to crust formation on the heat exchanger surfaces and due to difficulties in distribution of the two-phase mixture on the slurry side of the exchanger, the difficulties being the greater, the larger the size of the apparatus.

Direct heat exchange between reaction vapors and coal slurry would offer advantages. The type of mixing zone required for direct heat exchange is less affected by problems of distribution of the two-phase mixture and there is no danger of cracking occurring at superheated heat exchanger surfaces. Moreover, using the hydrogen as an essential constituent of the thermal gas ensures that the heating of the coal slurry always takes place in the presence of hydrogen.

Direct heat exchange in one step, or in a counter-current apparatus over a limited temperature range, has also already been employed. In both cases, a proportion of the vaporous reaction product condenses out in the coal slurry; this restricts the application of the direct heat exchange principle to relatively high temperatures. Extensive heat recovery by direct exchange is not possible by this method.

I have found that better utilization of the heat of reaction is achieved if some or all of the hot gases and vapors formed during the hydrogenation are intimately mixed with the coal slurry in a plurality of stages, and after the first mixing stage the gases are freed from the product, and the product-free gases, especially hydrogen, are used as a thermal medium.

In the hydrogenation process according to the invention, the gases and vapors leaving the reaction are cooled, in a first mixing stage, to a temperature of not less than 350° C., preferably from 380° to 440° C., especially from 390° to 410° C. The high-boiling oils are then removed in an intermediate separator. To achieve the above temperature in the intermediate separator, a preheating zone at a lower temperature is needed, in which the coal slurry is preheated. In the case of direct heat exchange, such treatment cools the reaction gas to below 350° C. However, below 350° C. too high a proportion of the reaction products precipitates and is returned, with the coal slurry, to the reactor. This accumulation of reaction products in the coal slurry and in the reaction zone is prevented by first discharging the reaction products from the reaction gases in a cold separator at about ambient temperature. The remaining gas, which has been freed from oil vapor, is then reheated in a heat exchanger in counter-current to the product-laden gas flowing to the cold separator, the latter gas thereby being cooled. The heated product-free gas can then serve as a thermal medium and supply the requisite heat to the coal slurry by direct heat exchange. If external heat is additionally needed to cover peak demand, then this external heat can be employed to heat the product-free gas, and accordingly no cracking reaction or carbon deposition occurrs on the heat transfer surfaces.

The advantage of the process according to the invention is essentially that only clean gases enter the heat exchanger in which external heat is supplied, while the coal slurry is subjected to direct heating in multi-phase mixing zones, which require substantially simpler and accordingly cheaper apparatus and where there is no danger of cracking reactions, of blockage of individual tubes or of superheating at the heat exchanger surfaces. The heating of the coal slurry is moreover always effected in the presence of hydrogen. Given suitable choice of the number of direct heating stages, the efficiency achievable is substantially the same as on the counter-current principle. It is also possible to construct the mixing stages, which are operated below 400° C. and where heat is supplied by gas from which the product has already condensed out, as a counter-current apparatus, so as to achieve even better heat utilization.

During indirect heat exchange between the gas from the reactor, which flows to the cold separator and contains product, and the residual gas which has been freed from product, a proportion of the useful heat content (for example the heat of condensation) is lost for regeneration purposes. If this heat is also to be utilized in the process, the amount of the residual gas must be increased. This is readily possible if the off-gas from coal slurry preheating, which has been cooled to room temperature and is to be subjected to gas purification, is split, a part-stream being admixed to the thermal gas (thus creating a circulatory system).

The advantage of the process according to the invention is that the coal slurry, which is difficult to treat, is brought to the reactor entry temperature by direct mixing with gases coming from the process, making it possible—in contrast to a one-step arrangement—to dispense entirely with external heat supply in most cases, or at least to reduce such external heat supply substantially.

Multi-stage direct mixing is made possible by the fact that after the first mixing zone the gas is separated from the useful product, so that in the colder mixing stages no more product can precipitate. Only by multi-stage direct mixing can optimum utilization of the well known advantages of direct heating over indirect heating in tube bundle heat exchangers be achieved. With direct heating in a mixing zone, the problem of distribution of the coal slurry in the heat exchanger can be tackled substantially better—especially in very large apparatus—than in the case of indirect heat exchange, where dead zones, which damage the product and cause crusts on the exchange surfaces, can easily develop. This is the main advantage over indirect counter-current heat exchange. The apparatus which can be employed as a mixing zone for direct heat exchange is substantially simpler than a tube bundle heat exchanger, especially when working under high pressure.

Direct mixing even makes it possible to employ coal which has not been predried. The expelled water vapor and other low-boilers are not passed through the reactor but instead are discharged direct via a cold separator. Even if predried, the coal still contains a substantial proportion of water which, as steam, increases the pressure in the reactor. Where direct heating is employed, this water is also discharged from the reactor, together with the volatile constituents of the coal and of the pasting oil, so that the reaction pressure can be lower, by an amount corresponding to the partial pressures of these low-boilers.

The process is described briefly below, in relation to the drawing, taking as an example the two-stage direct heating of the coal slurry in a coal hydrogenation process.

The vapors (10) leaving the hydrogenation reactor (9) are separated from liquid sludge in the hot separator (13) and are then intimately mixed with the coal slurry in the mixing zone (8), giving a mixture which is at about 400° C. The coal slurry and gas are then separated in the intermediate separator (7).

The slurry is conveyed into the reactor by the pump (6). The hydrogen required for the hydrogenation (21), namely fresh hydrogen plus the recycled hydrogen resulting from the process, enters the reactor simultaneously with the coal slurry. This gas stream is heated by heat recovery in the heat exchangers (19) and (15). An additional heat exchanger (12) is provided to allow supply of external heat when required.

The reactor gas separated off in the intermediate separator (7) is cooled to near room temperature in the heat exchangers (14) and (15), the cold-separator oil condenses out and can be removed, as stream (17), from the cold separator (16).

The product-free gas, which is heated by heat recovery in the heat exchanger (14) and, if external heat is needed, is additionally heated in the heat exchanger (11), passes to the mixing zone (2), where it is mixed with the coal slurry (1) entering the system, thereby heating the slurry.

For example, the slurry (1) is preheated from 100° C. to 230° C. in stage (2), while in the second mixing stage (8) it is further heated to the required temperature of 400° C. By appropriate utilization of heat coupling—which requires appropriate heat exchange surfaces—the requirement for external heat can be reduced to zero.

On heating the coal slurry in the preheating stage (2), low-boilers, for example water, are liberated and these, together with the thermal gas, are separated from the slurry in the separator (3). While the coal slurry is pumped to the preheating zone (8) by means of the slurry pump (5), the gas stream (4) is cooled in the heat exchanger (19) and passes to the separator (22). There, the water which has condensed out is separated off at room temperature, together with other low-boilers.

If, to achieve better heat recovery, the internal circulating gas stream passing through the exchange stage (2) is to be increased, a part-stream (20) can be taken, downstream of the separator (22), from the stream which is to be subjected to gas purification, and be pumped, by means of the circulation gas compressor (18), into stage (2) via (14) and (11).

I claim:

1. A process for hydrogenating coal in a slurry of coal and oil which comprises:
   contacting the slurry of coal and oil with hydrogen and a hydrogenation catalyst in a reactor;
   passing the hot vapors from the reactor to a first mixing zone wherein the vapors are mixed with a preheated coal and oil slurry and wherein the vapors heat the slurry to a temperature of at least 350° C. while the vapors are correspondingly cooled;
   separating the vapors from the slurry;
   pumping the heated slurry to the reactor; cooling the vapors and separating reaction product from product free gases; and
   thereafter mixing the product-free gases, which include hydrogen, with the coal and oil slurry in a second mixing zone, said product-free gases being used as a thermal medium to preheat said slurry.

2. The process of claim 1, wherein, after the first mixing stage, heat exchange between the gas and the coal slurry is effected in counter-current.

3. The process of claim 1 or 2, wherein the first mixing stage is operated at from 380° to 440° C.

4. The process of claim 1 or 2, wherein the first mixing stage is operated at from 390° to 410° C.

5. The process of claim 1 or 2,
   wherein the amount of gas, consisting essentially of hydrogen, which serves as the thermal medium is increased by recycling a part-stream so as to permit better utilization of the heat of reaction and to minimize any additionally required external heat.

* * * * *